United States Patent [19]

Peters

[11] 3,977,141

[45] Aug. 31, 1976

[54] METAL SHAKE OR SHINGLE PANEL AND ACCESSORIES

[75] Inventor: Robert M. Peters, Lower Burrell, Pa.

[73] Assignee: Aluminum Company of America, Pittsburgh, Pa.

[22] Filed: Oct. 23, 1974

[21] Appl. No.: 517,101

[52] U.S. Cl. ..... 52/313; 52/528; 52/534

[51] Int. Cl.[2] ..... B44F 9/02; E04D 1/00

[58] Field of Search ..... 52/518–560, 52/311–316, 74, 588

[56] References Cited

UNITED STATES PATENTS

| | | | |
|---|---|---|---|
| 2,682,236 | 6/1954 | Holmstrom et al. | 52/518 X |
| 3,312,031 | 4/1967 | Berg | 52/534 X |
| 3,430,395 | 3/1969 | Lashkow | 52/531 X |
| 3,593,479 | 7/1971 | Hinds | 52/313 |
| 3,608,261 | 9/1971 | French et al. | 52/316 |

*Primary Examiner*—J. Karl Bell
*Attorney, Agent, or Firm*—Elroy Strickland

[57] ABSTRACT

A panel structure comprised of a plurality of side-by-side segments formed to present the configuration and aesthetics of hand-split wooden shakes for a building roof and/or wall, and trimming and finishing accessories therefor similarly formed to simulate wooden shake structures.

7 Claims, 13 Drawing Figures

FIG. 5.
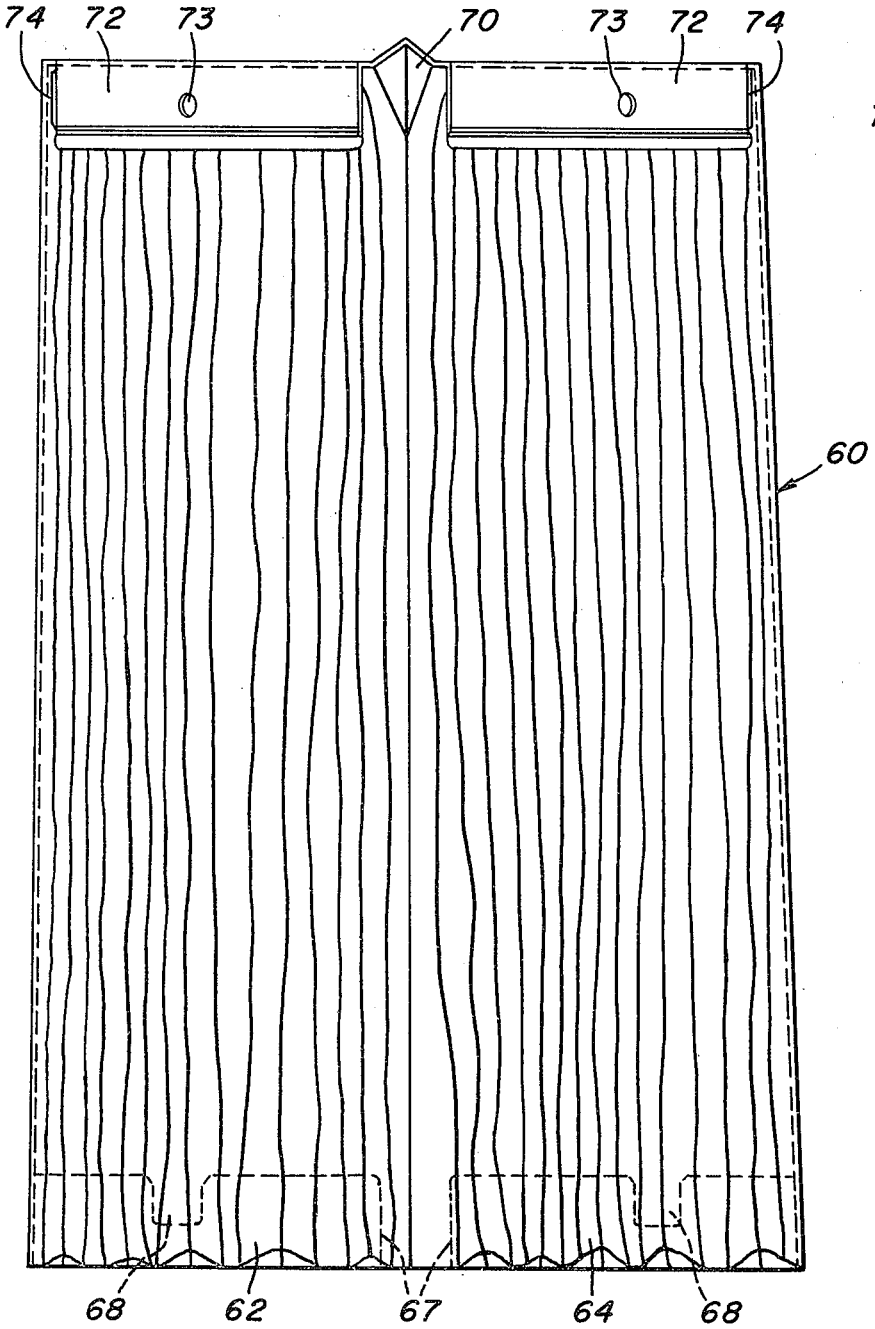
FIG. 7.
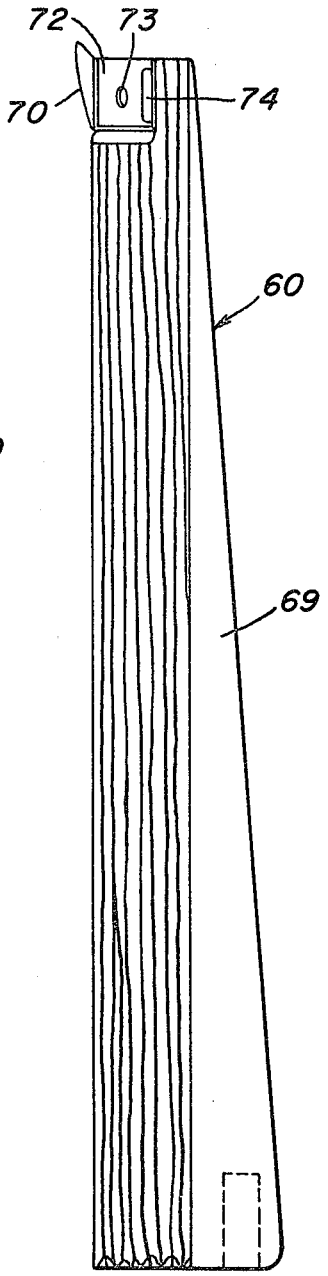
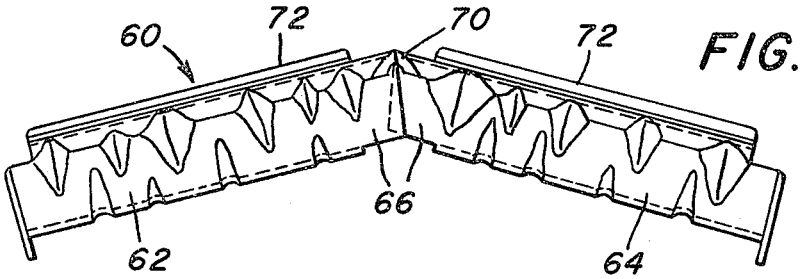
FIG. 6.

METAL SHAKE OR SHINGLE PANEL AND ACCESSORIES

BACKGROUND OF THE INVENTION

The present invention relates to a machine-made, prefabricated shingle or shake structure, and to a prefabricated shake system which includes accessories for trimming and otherwise completing the covering of a roof and/or wall of a building with the shake structure and accessories.

Heretofore, machine-made shingles have involved a variety of designs and design features, which features have included the simulation of the surface profile of a wooden shingle. In a similar manner, shakes have been manufactured from metal sheet material, which shakes have attempted to simulate the configuration and randomness of hand-split wooden shakes. However, these shakes have not been aesthetically pleasing in that the surface grain of the shakes did not simulate the roughness of hand-split shakes, and the shakes of the panel have been of the same length so that the lower edge of the panel did not have a staggered edge configuration which would more truly resemble hand-split shakes. It is easier to make the shakes when the segments are all of one length since the stretching and tearing that would occur using ordinary techniques for a staggered butt configuration are thereby avoided.

Another problem that has been encountered in the use of metal shingles and shakes has been the rattling and noise accompanying windy atmospheric conditions. Such structures are not firmly held to the wall or roof thereby tending to allow movement of the shingle under high wind conditions.

Yet another problem attending the use of machine-made shingles and shakes is that of the penetration of water and airborne moisture beneath the shingles and into the area between the shingle and its supporting (wall or roof) structure.

BRIEF SUMMARY OF THE INVENTION

The present invention is directed to a metal or plastic shingle or shake panel having preferably an even number of shake segments of desired random widths, and of longer and shorter lengths, and of high and low elevations. A plurality of such panels, when properly installed on the roof or side of a building, and viewed from a minimal distance, provide an aesthetically appealing appearance closely resembling that provided by a roof or wall of hand-split wooden shakes. Each shake segment is provided with a plurality well defined but varying triangular profile ridges, when viewed from the butt of forward end of the segment, extending lengthwise of the segment, and with a uniform depth trough or groove separating and extending the full length of the segments.

The rattling noise and airborne moisture problems are mitigated with the present invention by the use of a forwardly facing integral return bend portion located at the rearward or upper edge of the panel and extending the full length of the panel, the return bend being doubled back upon itself to extend rearwardly and downwardly toward a supporting roof or wall surface to provide an elongated fastening flange extending substantially the full length of the panel. The integral return bend forms a barrier to wind and moisture, while the rear flange provides a means for receiving fasteners the full length of the panel.

The structure of the invention has other desirable features and advantages, as well as related, accessory components, with their own concomitant advantages, as explained in detail hereinafter.

THE DRAWINGS

The invention, along with its objectives and advantages, will be best understood from consideration of the following detailed description when read in connection with the accompanying drawings in which:

FIGS. 5, 6 and 7 are, respectively, top, front, and side elevation views of a roof ridge cap of the invention;

PREFERRED EMBODIMENT OF THE INVENTION

Figure 1:
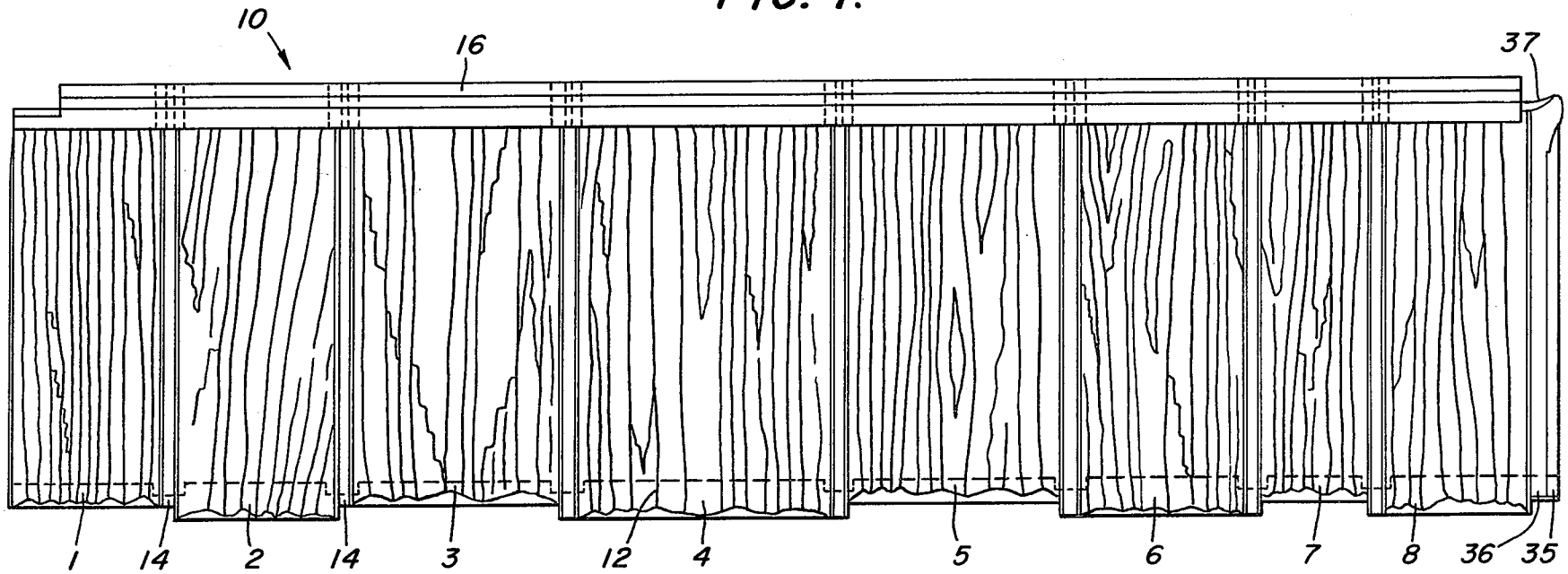
FIG. 1 is a top plan view of the shake panel of the invention.
Figure 2:
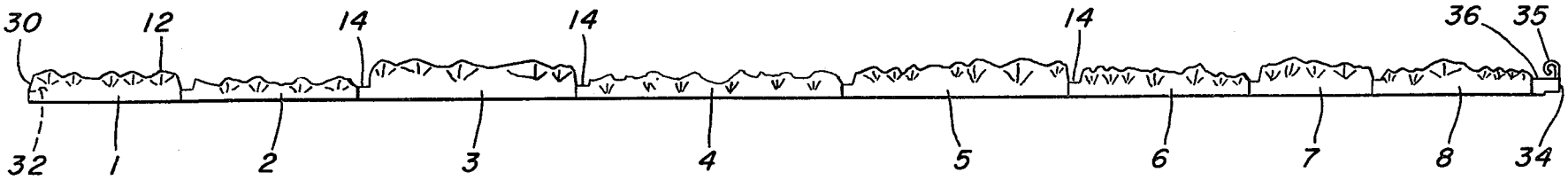
FIG. 2 is a front elevation view of the panel of FIG. 1, with FIGS. 2A and 2B showing enlarged sections of the left and right hand ends, respectively, of the panel.
Figure 3:
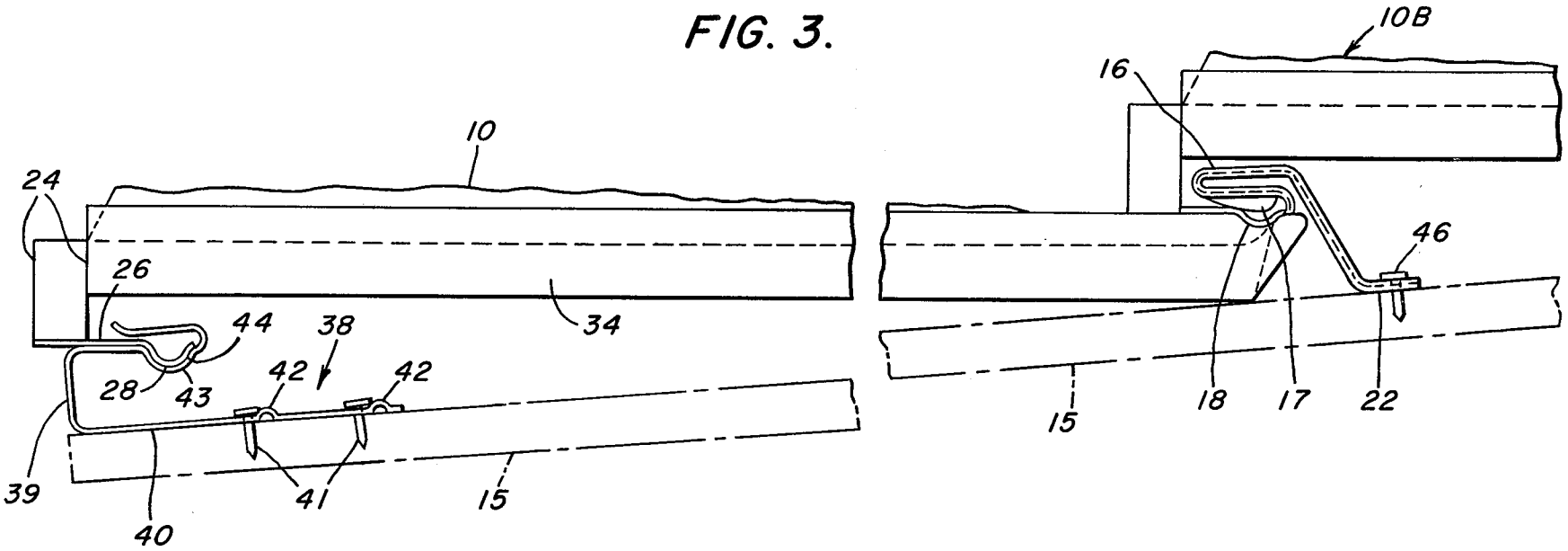
FIG. 3 is a right side elevation view of the panel of FIGS. 1 and 2, and of a starting strip for the panel.

Referring now to FIGS. 1 to 3 of the drawings, a panel 10 is shown in which eight shake segments, respectively numbered 1 to 8, are formed from a planar sheet of metal, an aluminum alloy for example, by a sequence of bending and folding steps performed in a press (not shown) having suitably constructed shake forming dies. The bending and folding process provides troughs 14 between the segments, the troughs clearly delineating and separating adjacent segments, as best seen in FIG. 2. The troughs have a uniform depth extending lengthwise of the segments. To further simulate the appearance of hand-split wooden shakes, the segments are provided with triangular ridges 12 of a variety of heights and angles, via a stretch forming process, the ridges extending generally lengthwise of the segments.

As seen in FIGS. 1 to 3, the segments of panel 10 are formed to occupy alternately high and low elevation positions and have varying widths, with the alternately high and low segments also having alternating shorter and longer lengths, which provide the panel with a staggered, lower edge configuration. Preferably, the high elevation segments 1, 3, 5 and 7 of the panel are the shorter ones of the segments, such that the height of the forward or butt ends of the high segments equals the amount of the shortening. In this manner, the high elevation-short length segments and the low elevation-long length segments provide substantially equal supplies of metal for the segment forming process (in a suitable press not shown) such that little or no stretching of the metal takes place at the lower or butt end of the panel in the forming process. Thus, stretching is avoided, and the butt areas are formed by bending and folding techniques that result in reduced loading of the press and a minimum of production problems.

In FIG. 3, the panel 10 is shown fastened to a supporting surface 15, such as a roof or wall surface of a building.

The rear or upper edge of panel 10 and the segments 1 to 8 terminate in an integrally formed, forwardly facing return bend or hook structure 16, the hook structure having a double wall formed by folding the metal thereof back upon itself. The hook structure extends over the upper face of the segments and lengthwise of the panel for the full length thereof. Beneath the hook portion, an elongated groove 18 is provided in the upper face of each segment for receiving a bead of a like adjacent panel located immediately above panel 10, as explained in detail hereinafter.

At spaced apart locations along the length of the return bend or hook structure 16, the wall portion thereof facing the groove 18 is provided with cuts or slits 17 that provide bare metal edges facing in the direction of grooves 18. Such bare metal edges are effective to scrape any paint or coating on the leading edge or bead of a like adjacent panel when the leading edge or bead is disposed in place in groove 18. In this manner, electrical contact and continuity is made between adjacent panels.

The folded over portion of the return bend or hook structure 16 extends rearwardly and downwardly toward the supporting surface 15 to provide a flange 22 for fastening the panel to the surface, the flange, like the hook structure extending to the full length of the panel.

The lower or front end of each segment terminates in a front wall 24, extending in a plane substantially perpendicular to the plane of the main body of each segment, and a return bend 26 extending beneath each segment in a plane substantially parallel to that of the segment. In each return bend 26 is provided a downwardly protruding bead 28, the beads 28 being in longitudinal alignment for seating in the above-discussed groove 18 of a like adjacent panel 10B (FIG. 3) located immediately below panel 10, or in the groove of a starter strip discussed in detail hereinafter. Since the segments have alternate lengths, yet the beads 28 in return bends 26 thereof are longitudinally aligned, the lengths of the return bends are proportionately longer for the longer segments.

Figure 2B:
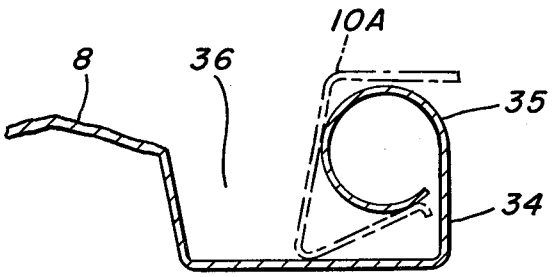
Figure 2A:
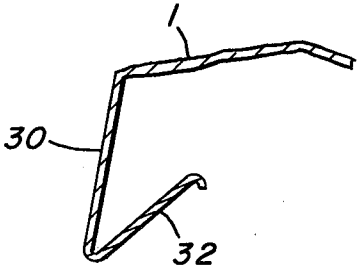

The left-hand side of panel 10 terminates in a wall 30 located in a plane approaching the perpendicular of that of segment 1, the wall 30, in turn, terminating in an inwardly and angularly upwardly directed flange 32 located beneath segment 1, as best seen in the sectional view of FIG. 2A.

The right-hand side of panel 10 terminates in a wall 34 provided with a circular return bend 35 located over a trough 36 located at the right-hand edge of segment 8, the wall 34 being integral with the trough and extending upwardly therefrom. The circular return bend forms an elongated cylindrical segment that extends along the right-hand edge of the panel and trough 36, and terminates a short distance from the rear or upper end of the panel and trough. The upstanding wall 34, however, continues on and joins an upstanding wall 37 at the upper end of trough 36, and in general alignment with folded over return bend 16, the wall 37 extending the full depth of the trough and the height of the return bend 16.

To begin installation of the panel structure 10, as thus far described, an elongated starter strip 38 is first attached to the lower edge of the roof or wall 15 in the manner indicated in FIG. 3. More particularly, strip 38 is elongated (into the plane of the paper in FIG. 3) to form a continuous strip for starting a row or course of the panels 10 disposed in end-to-end relationship along the lower edge of the roof or wall. The starter strip functions to angle out the first row or course of panels from the plane of the roof or wall 15 by an amount corresponding to that of the next row of panels, the next row being angled out by the depth of the segments 1 to 8 of first row of panels. Thus, the starter strip has a front wall 39, the height of which corresponds to the thickness of segments 1 to 8 at their upward or rearward ends. Integral with, and extending rearwardly from the lower edge of the front wall 39 in plane perpendicular thereto, is a planar main body portion 40 of the starter strip for disposal on and for fastening to the supporting surface 15. Fastening may be accomplished by means such as nails 41 extending through the main body portion and into the roof or wall 15, as shown in dash outline in FIG. 3. The main body portion may be fabricated with two rows of openings (not shown) extending along the strip for receiving the fastening means, and with raised, continuous bead portions 42 located behind each row of openings for the purpose of stiffening the flat portion.

Extending rearwardly from the upper edge of the front wall 39 of the starter strip 38, and in a plane substantially parallel to the main body portion 40, is another integral wall 43 provided with an elongated, continuous groove 44 for receiving the beads 28 of the segments 1 to 8, as shown in FIG. 3. The beads 28 and groove 44, as well as grooves 18 in the segments 1 to 8, could, of course, be reversed, the purpose of such beads and grooves being simply to secure newly positioned panels 10 in place before the panels are otherwise fastened to supporting surface 15. Each panel is fastened to the supporting surface by driving a row of fastening means 46, such as nails, into the supporting surface 15 through continuous flange 22 of the panel, as shown in FIG. 3.

In applying a first row or course of the panels 10 on a supporting surface, the left and right ends of adjacent panels are interconnected in the following manner. After a first panel is suitably secured to a supporting surface, starting from the left-hand edge of surface 15, for example, the right-hand end of the panel is free for receiving the left end of the next, adjacent panel, indicated by numeral 10A in FIG. 2B. This is accomplished by sliding the angled flange 32 of the next panel onto the cylindrical return bend 35 of the first panel, as shown in FIG. 2B, or by snapping the flange and circular bend together, the flange and bend being sized to provide a resilient clamping force that functions to hold the lower edge of the wall 30 against the bottom surface of the trough 36, again, as seen in FIG. 2B. In this manner, a gap between the wall 30 and trough 36 of any two, side-by-side, interconnected panels is prevented and a good appearance is provided. In addition, the end wall 30 and flange 32 are hidden from view by the front wall 24 of segment 1.

After the first course or row of panels 10 is secured and fastened to a supporting surface in the manner indicated above, the next course or row of panels is located above the first course on the supporting surface by first inserting the return bend 26 at the lower end of each panel of the next course (indicated by panel 10B in FIG. 3) beneath folded-over hook portion 16 of each panel of the first course such that the beads 28 of the next course seat in the grooves of the first course, as shown in FIG. 3. As indicated above, the beads 28 and grooves 18 hold the panels of the second course in place until the rear flanges 22 thereof can be fastened to the supporting surface.

With the rear flange 22 of each panel suitably secured to the supporting surface 15, the continuous, folded-over return bend 16 at the rear of the panels provides a barrier to any wind, water or airborne moisture that might otherwise enter between the courses of panels, as well as providing a high strength, rigid panel that can withstand the forces attendant with severe weather conditions. Between the interconnected panels in any given row thereof, the wall 37 at the upper end of trough 36 serves as a dam to prevent water or airborne moisture from entering between the panels at the location of the trough end.

The segments 1 to 8 of panel 10, as indicated earlier, have varying widths, with the locations of the varying width segments being such that a variety of starting or finishing edge panels will avoid trough over trough situations as well as an interruption of repeat patterns when the panels are applied to a roof or wall.

Figure 4:
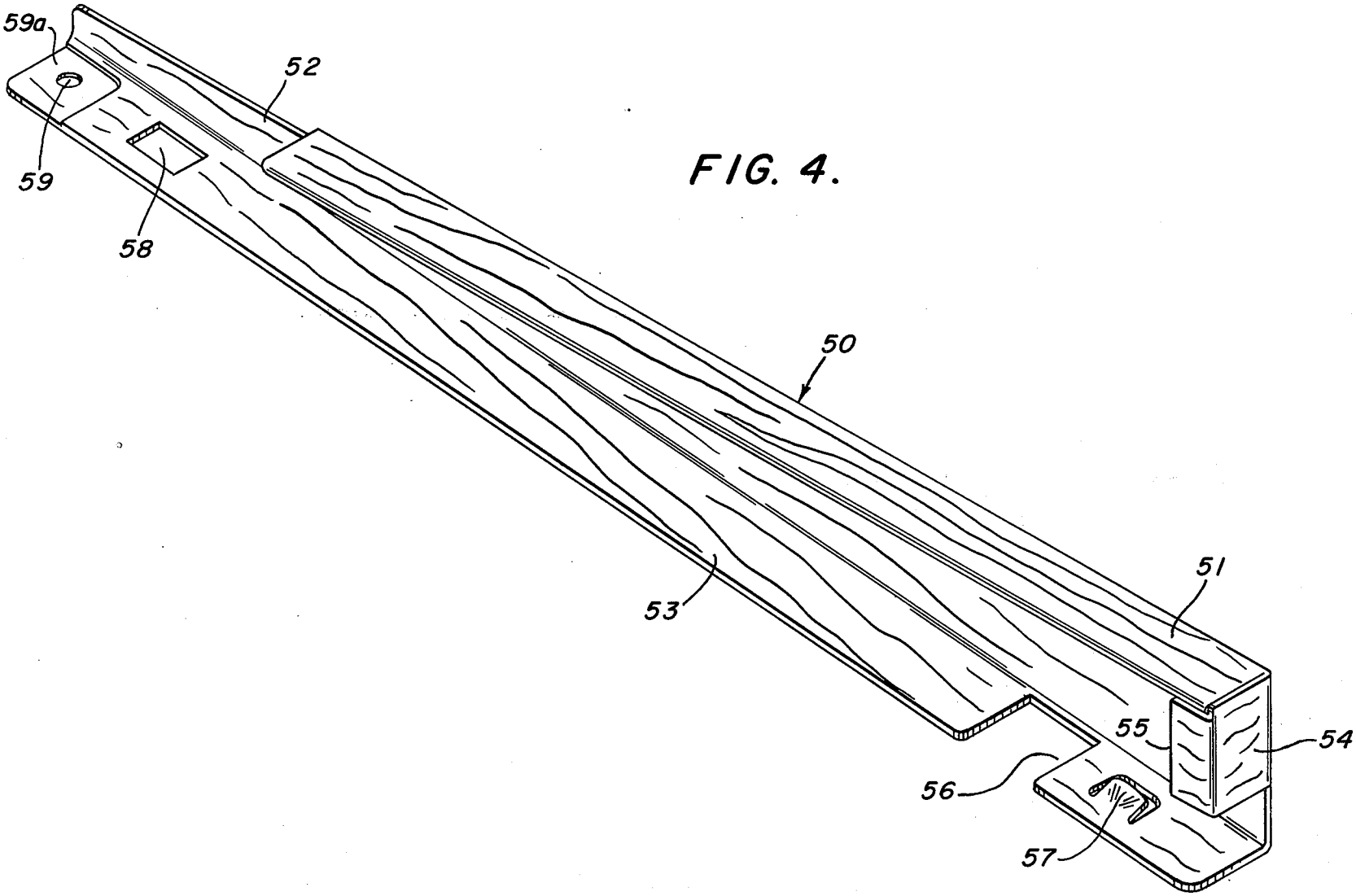
FIG. 4 is a perspective view of an end cap for the panel of FIGS. 1 to 3.

The ends of the panels 10 can be closed by end caps, such as the cap 50 shown in FIG. 4, only one cap being shown in FIG. 4. As shown, end cap 50 has an upper wall 51, a side wall 52 and a bottom wall 53, all disposed at substantially right angles to each other, and elongated in the direction in which the cap extends when applied to an end of panel 10. In addition, the end cap has a front wall 54 substantially perpendicular to the three elongated walls, with an inwardly turned lip 55 extending in a plane normal to that of the wall. The walls 51, 52 and 54 are provided with surface profiles that simulate a wooden shake. The length dimensions of the side and lower walls correspond to the length of the panel 10, with the side wall 52 decreasing in height in the direction of the upper or rearmost end of the cap.

As will be noted in FIG. 4, the upper wall 51 of the end cap 50 terminates short of the full length of the end cap to accommodate rear wall portion 37 of the shake panel 10 when the end cap is installed.

Preferably, the lower wall of the end cap terminates along an elongated edge (spaced from the side wall 52 of the cap) that is slightly beyond the elongated edge of the upper wall 51, the lower wall being provided with a slot or cut-out portion 56 extending inwardly from the free edge at a longitudinal location near but spaced from the forward end of the end cap. Between the forward end of the cap and slot 56 is provided a tab 57 integral with wall 53 and having a free end facing side wall 52, the tab being slightly raised above the upper surface of wall 53.

Toward the rearward end of end cap 50 is provided an opening 58 in lower wall 53 and at a location to receive tab 57 of the next adjacent end cap (not shown) when the ends of the shake panels 10 are closed by the end caps. Behind the opening 58 is an opening 59 for receiving a fastener, such as a nail, for securing the cap to the roof or wall surface 15 (FIG. 3) of a building. Around opening 59 is a depressed area 59a that seats into slot 56 of the next adjacent end cap (not shown).

The end caps 50 are installed by placing the first cap on one end of the panel 10 located at the lowermost edge of a building roof. When placed on the end of a panel 10, the lip 55 of the cap 50 can either extend to the lower end of a short segment of the panel or be folded back so that the front wall 54 of the cap can accommodate a long segment of the panel. With the lip 55 of front wall 54 extending, as shown in FIG. 4, or folded, the hole 59 in lower wall 53 is located beyond the upper edge of the panel so that a nail or other fastener (not shown) can be driven through hole 59 to secure the upper end of the cap to wall or roof surface 15. The next cap is disposed on the end of the next adjacent panel (immediately above the previous panel) by sliding the forward end of the cap over upper edge and wall 37 of the previous panel, and sliding lower wall 53 of the cap underneath the next panel in a manner that locates the slot 56 of the cap around the fastener driven through hold 59 of the cap. This will locate the tab 57 of the cap in the opening 58 of the first or previous cap. This procedure is repeated until all of the ends of the panel rows are covered by the end caps.

To finish the peak or ridge of a roof containing the shakes of the invention, a ridge cap 60, as shown in FIGS. 5, 6 and 7, may be employed. Ridge cap 60 comprises two main, and generally planar, wall sections 62 and 64, which form the main wall of the cap, and are formed with longitudinally extending, triangular shaped ridges to provide the appearance of a hand-split wooden shake. The sections 62 and 64 are angularly disposed with respect to each other at an angle corresponding to the angle of the pitch of the roof on which the ridge cap will be disposed. Each section has a forwardly facing wall 66 (FIG. 6) which is formed to simulate the cut edge of a wooden shake, and a return bend portion 67 extending beneath the main sections, as seen in hidden outline in FIG. 5. Each return bend is provided with a fastener slot 68 to allow assembly of the next adjacent ridge cap to a roof surface. Further, each section 62 and 64 has a side wall 69 (FIG. 7) extending from front to rear of the cap, and decreasing in height in going from front to rear. The walls 66, 68 and 69 generally depend or extend at right angles to the plane of their supporting wall structures.

At the rear center or crest of cap 60 is a raised portion 70 providing a dam to any water that might try to enter between the overlapping portions (not shown) of adjacent caps. Further, at the rear of each section of cap 60 is a return bend 72 folded over the sections and adapted to extend over the return bends 67 of the next ridge cap when the peak of a roof is being finished by a line of such caps, the return bends 72 functioning to secure the forward end of the next cap to the roof.

The rear of the cap 60 is secured to a roof by fasteners (not shown) driven into the roof through holes 73 provided in the return bends and in the sections of the ridge cap under the return bends, the holes in each return bend and section being aligned to receive the fastener, and located in such a manner that the return bends 67 of the forward end of a next adjacent ridge cap will accommodate the fasteners in the slots 68 provided in the forward return bends. In this manner, the forward end of the next adjacent cap is secured to the ridge of a roof in the process of finishing the ridge with a line of the ridge caps of the invention.

At the opposed, outside edges or ends of the rear return bends 72 is provided an upstanding tab 74 for strengthening return bend 72.

Figure 8:
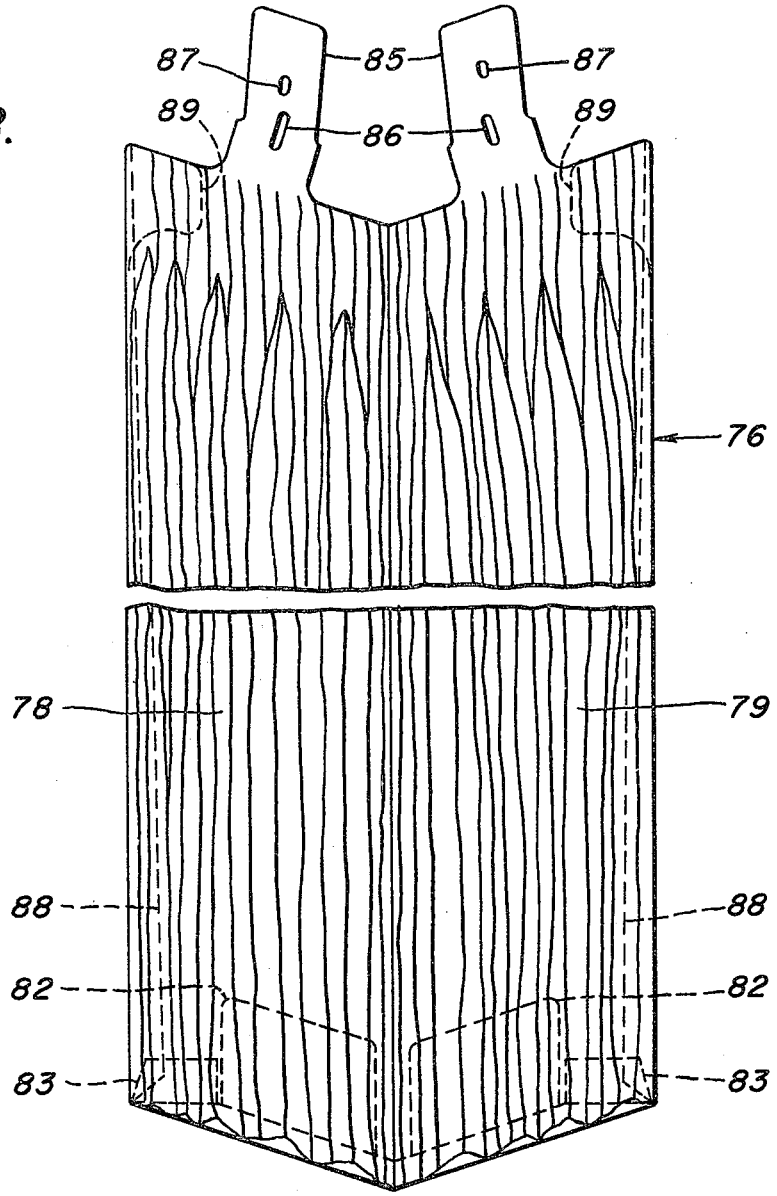
FIGS. 8 and 9 are, respectively, top and front end elevation views of a corner cap of the invention.
Figure 9:
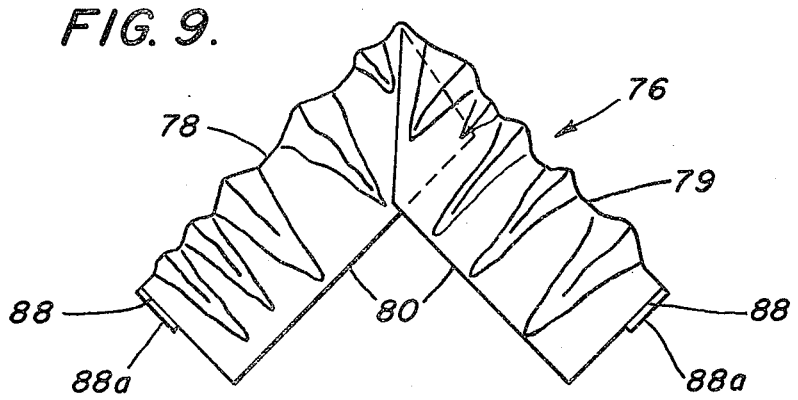

FIGS. 8 and 9 of the drawings show a corner cap structure 76 for a 12° mansard roof, though the invention is not limited to such a mansard roof. For example, a corner cap for a completely vertical wall would be quite similar to the structure depicted in FIGS. 8 and 9.

More particularly, like the ridge cap described above, the corner cap 76 comprises two angularly disposed sections 78 and 79 provided with a surface profile simulating that of a solid wooden shake, and forward, depending wall portions 80 (FIG. 9) are formed to represent the cut surface of a wooden shake. Beneath each section 78 and 79 extends a relatively large, inside flange or tab 82 and a relatively small, outside tab 83, the tabs being integral with and disposed at substantially right angles to front wall portions 80, and generally parallel with the plane of sections 78 and 79. The purpose of the large tabs is to secure the front end of the cap to the shake panel 10 by interlocking with the lower end of the shake panel, the tabs 82 being slipped beneath the lower return wall 26 of the shake panel in the process of installing corner caps 76 on a wall or mansard roof.

Because of varied layup patterns for panels 10, the outer edges of the corner caps will encounter either long or short panels intrinsic to the staggered butt profile. The small tabs 83 serve to close the spaces that would occur in an assembly with a short panel segment and, when such spaces do not exist, are folded back and out of the way against the inside surface of wall 80.

The upper end of the corner cap 76 is provided with integral, rearwardly extending fastening tabs 85 provided with holes 86 and 87 for receiving means (not shown) to fasten the upper end of the cap to a wall or mansard roof surface. Hole 86 is elongated and is the preferred fastening hole since it restricts movement of the cap to a much greater degree than a fastener located in hole 87, and results in less deformation of the tab, the fastener extending into the wall or roof through hole 86 at a location in close proximity to the rear edge 16 of the shake panel 10.

At the opposed sides of the corner cap 76 are shown elongated side walls 88 extending between the front and rear edges of the cap. The side walls are preferably provided with a tab 89 and a score line or lines 88*a* (FIG. 9) for removing a portion of the side walls for the purpose of more closely fitting the side walls to the surface of a high panel in shake panel 10 lying beneath the cap on a wall or mansard roof. If a portion of a side wall 88 is not removed, its associate tab 89 is simply folded under the association section (78 or 79).

Figure 10:
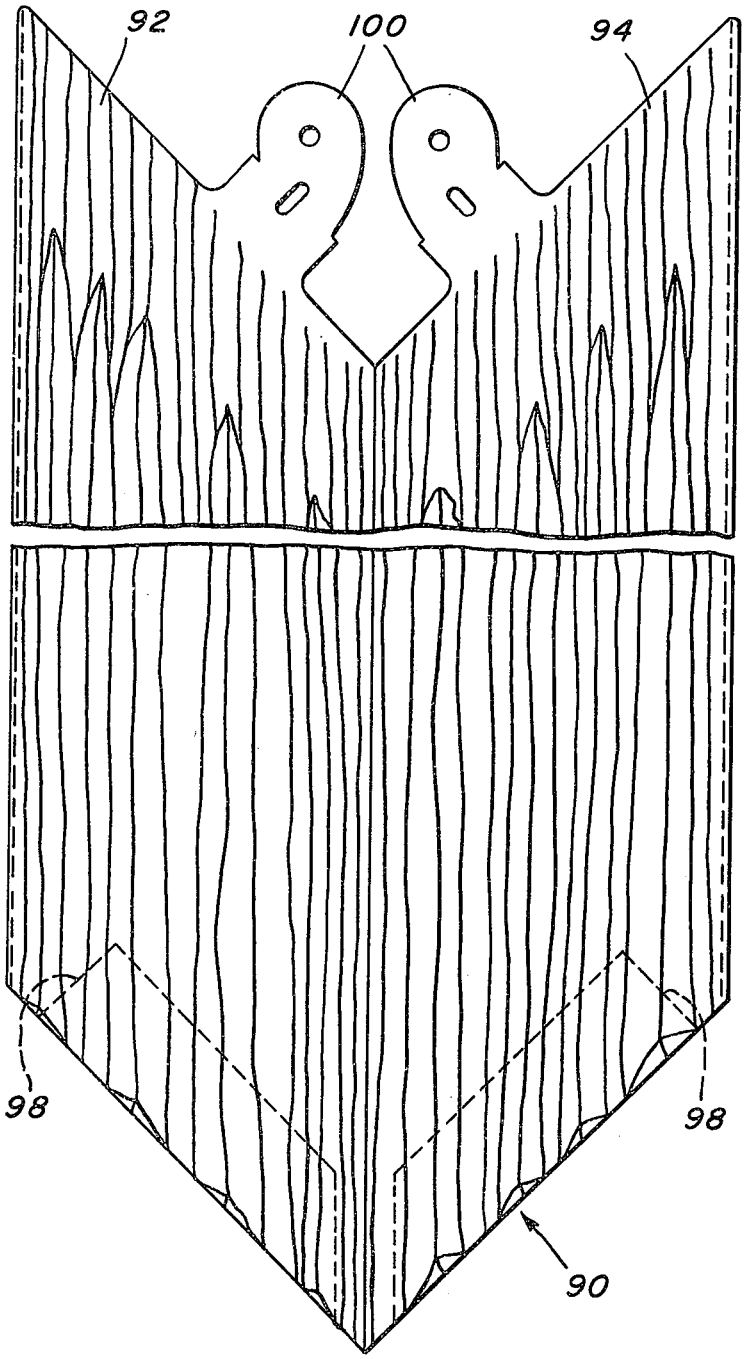
FIGS. 10 and 11 show, respectively, top and side elevation views of a hip cap of the invention.
Figure 11:
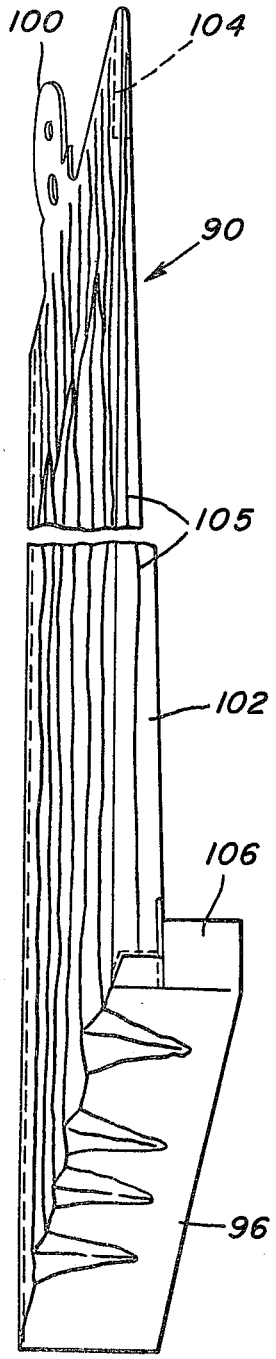

FIGS. 10 and 11 show a hip cap 90 of the invention for sloping roofs having a shingle or shake covering. Like the ridge and corner caps described above, the hip cap comprises two panel sections 92 and 94 provided with longitudinally extending, triangular ridges and grooves providing the appearance of a hand-split wooden shake. The forward or lower edge of each section is provided with an integral wall 96 depending at a right angle with respect to the plane of its section, and provided (again) with triangular ridges to simulate the roughened, cut surface of a wooden shake. The walls 96 are, in turn, provided with rearwardly extending tabs or flanges 98 adapted to be located beneath the lower edge of the shake panels of the invention fastened to a sloping roof.

The rear of the hip cap 90 is provided with rearwardly extending fastening tabs 100 that function to secure the cap in the manner described above in connection with corner cap 76. Similarly, the opposed sides of the cap are respectively provided with elongated, tapering side walls 102, which walls may each have a tab 104 and a score line 105 for removing a portion or portions of each side wall.

Beneath each side wall 102, and in the general plane thereof, is located a rearwardly extending tab 106, the tabs 106 serving a purpose similar to that of tabs 83 described above in connection with corner cap 76.

The fabricated shake panel 10, and the other components described above in connection with the shake panel, provide a novel and unobvious system for covering a building, particularly the roof of a building, that is economical to install, structurally strong, long lasting in life and aesthetically pleasing.

Whereas particular embodiments of the invention have been described above the purposes of illustration, it will be evident to those skilled in the art that numerous variations of the details may be made without departing from the invention as defined in the appended claims.

What is claimed is:

1. A shingle or shake-like panel for fastening to a supporting surface, such as a wall or roof of a building, the panel comprising a plurality of adjacent, alternate, shorter and longer segments of alternately high and low elevations and varying widths made from sheet material in a bending and folding process, the low elevation segments being the longer segments and the high elevation segments being the shorter segments so that an equal amount of material is employed in making both the low elevation, long segments and the high elevation, shorter segments, the longer and shorter segments providing the panel with a staggered, forward or lower edge configuration, and having a plurality of longitudinally extending, triangular ridges of varying heights and slopes, said longer and shorter segments being separated by integral troughs, with each trough having a constant depth extending lengthwise of the segments, the forward or lower end of each segment terminating in a front wall having a return bend portion extending beneath the segments, the rear or upper edge of the panel terminating in a continuous, forwardly facing hook portion folded over the panel, the hook portion having an integral fastening flange extending rearwardly and downwardly toward the supporting surface for the panel.

2. The structure of claim 1 in which there are an even number of said segments.

3. The structure of claim 1 in which the continuous hook portion of the panel is provided with tabs having a bare metal edge facing in the direction of the upper surface of the segments, said tabs being effective to make good electrical contact with an adjacent panel when a return bend thereof is inserted between the tabs and the upper surface of the segments.

4. The structure of claim 1 in which one side of said panel terminates in a trough having a generally circular return bend, said return bend extending upwardly from and generally inwardly over said trough, and the other side of the panel terminates in a downwardly extending return bend having a generally U or V-shaped configuration facing the bottom surface of the panel, the circular return bend of said panel being effective to resiliently secure a like adjacent panel to said panel when the circular return bend is disposed in the V of the V-shaped return bend of the adjacent panel, the return bends of both panels being effective to hold the lower edge of the V of the adjacent panel on the bottom surface of the trough of said panel.

5. The structure of claim 4 in which the end of the side trough located adjacent the forward or upper end of the panel is terminated by a water dam, the height of which extends the full depth of the trough.

6. An elongated starter strip for disposal beneath the forward end of the panel of claim 1 for beginning a row of such panels at the lower edge of a building roof or wall, said strip having an elongated, substantially planar, main body portion for receiving means to fasten the strip to a roof or wall, an integral, front wall portion extending upwardly from the forward end of said main body portion, said front wall portion having a wall portion extending rearwardly therefrom in a plane substantially parallel to said main body portion, said rearwardly extending wall portion having an elongated groove for receiving a panel bead, the rearwardly extending wall portion having a return bend for receiving the return bend portions of the segments of the panel.

7. The starter strip of claim 6 in which an elongated, continuous bead is provided in the main body portion of said strip, and is located immediately behind the openings in the main body portion.

* * * * *